United States Patent [19]

Smook et al.

[11] Patent Number: 4,927,586

[45] Date of Patent: May 22, 1990

[54] PROCESS FOR PREPARING POLYVINYL ALCOHOL YARN

[75] Inventors: Jan Smook, Dieren; Gerardus J. H. Vos, Westervoort; Johannes A. Juijn, Velp; Theodorus J. Van Hees, Dieren, all of Netherlands

[73] Assignee: AKZO N.V., Arnhem, Netherlands

[21] Appl. No.: 238,602

[22] Filed: Aug. 31, 1988

[30] Foreign Application Priority Data

Aug. 31, 1987 [NL] Netherlands ..... 8702038
Aug. 5, 1988 [DE] Fed. Rep. of Germany ..... 3826621

[51] Int. Cl.[5] ..... D01F 6/14

[52] U.S. Cl. ..... 264/185; 264/210.8; 264/211.14

[58] Field of Search ..... 264/185, 176.1, 178 F, 264/183–184, 210.8, 211.14; 425/67, 71, 72.2, 192 S, 461–464

[56] References Cited

U.S. PATENT DOCUMENTS 2,322,976 6/1943 Schmitz ..... 264/185
2,447,140 8/1948 Shelton et al. ..... 264/185
3,066,999 12/1962 Nakajo et al. ..... 264/185
3,278,282 10/1966 Jaray ..... 65/1
4,698,194 10/1987 Tanaka et al. ..... 264/185

FOREIGN PATENT DOCUMENTS 0105169 4/1984 European Pat. Off. .
0146084 6/1985 European Pat. Off. .
1102340 3/1961 Fed. Rep. of Germany .
61-63704 4/1986 Japan ..... 425/461
6410847 3/1965 Netherlands .

*Primary Examiner*—Hubert C. Lorin
*Attorney, Agent, or Firm*—Oliff & Berridge

[57] ABSTRACT

In a process for preparing a polyvinyl alcohol yarn of high tenacity, a solution of polyvinyl alcohol in an organic solvent is extruded from a spinneret into a coagulation bath through an air gap or inert gas gap, and the extruded solution is drawn. The spinneret has capillaries which are at least five times their diameter in length and the concentration of the polyvinyl solution is at least $30-(\overline{M}_v/20{,}000)$ in percent by weight of the polyvinyl alcohol solution.

14 Claims, 1 Drawing Sheet

PROCESS FOR PREPARING POLYVINYL ALCOHOL YARN

BACKGROUND OF THE INVENTION

The invention relates to a process for preparing a yarn from polyvinyl alcohol having a viscosity average molecular weight $\overline{M}_v$ in the range of $10^5$ to $4\times10^5$. In this process, a solution of polyvinyl alcohol in an organic solvent is extruded from a spinneret into a coagulation bath through an air gap or inert gas gap and then drawn. Such a process has been proposed in European Patent Application No. 146,084 (EP No. 146,084).

Although the examples demonstrate that strong yarns can be obtained, applicants have been unable to prepare yarns of comparable properties using the data given in EP No. 146,084. In addition, the low concentrations of polyvinyl alcohol used in the examples of EP No. 146,084 make the process even less economically attractive.

SUMMARY OF THE INVENTION

The invention now provides a process by which yarns of polyvinyl alcohol having high tenacity and other favorable physical properties may be obtained from polymer solutions with a much higher concentration of polyvinyl alcohol.

In a process of the known type mentioned above, the length of the capillaries of the spinneret in the direction of flow is at least 5 times their diameter and the concentration C in % by weight of the polymer solution is selected so that $C \geqq 30-(\overline{M}_v/20{,}000)$.

The yarns produced using this process are found to have both high strength and good water resistance. For the rest, the mechanical properties largely correspond to those given in said European Patent Application, albeit that they are obtained at lower draw ratios than are mentioned therein.

DESCRIPTION OF PREFERRED EMBODIMENTS

Figure 1:
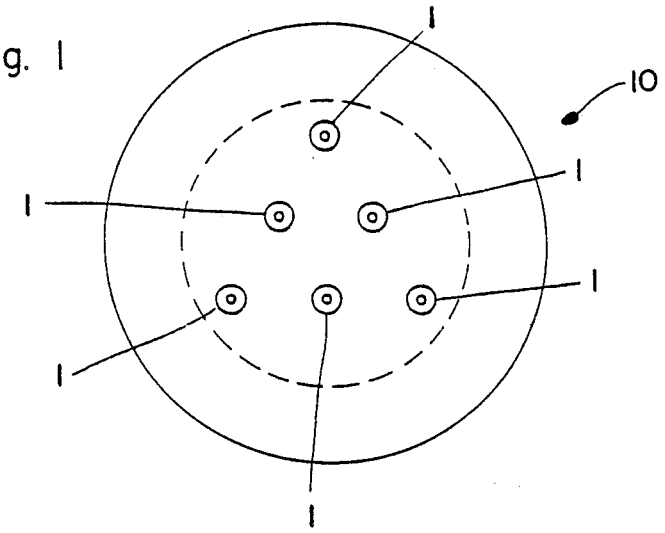
FIG. 1 is an enlarged plan view of a spinneret used in the present invention.

To obtain filaments of sufficient strength, it is essential according to the invention that use be made of spinnerets having a capillary length of at least 5 times its diameter. It is preferred that the spinneret should have capillaries of constant diameter over their entire length. Although in principle favorable results may always be obtained when a length/diameter ratio is less than 5, it is preferred, for economic and technological reasons, that the length/diameter ratio of the capillaries is in the range of 5 to 50.

The best results are found to be obtained when a length/diameter ratio of the capillaries is in the range of 20 to 40.

Advantageously, the die bases may consist of polyether ether ketone or polyphenylene sulfide, which respectively, are reinforced with, for example, 30% by weight of carbon fibers. In such die bases, which are not attacked by N-methylpyrrolidone and other organic solvents at higher temperatures, die capillaries with the claimed large length/diameter ratio can be bored particularly easily. The gel cannot adhere to the surface of such spinnerets, and therefore particularly good spinning behavior is to be observed.

According to the invention, use may advantageously be made of a process in which the spinning composition is extruded from the spinneret through adjacent capillaries at a level different from that of the spinneret surface. Such a process can only be carried out using a special spinneret construction.

Conceivable constructions comprise both an embodiment with the capillaries protruding from the spinneret surface and an embodiment in which the ends of the capillaries are level or almost level with the spinneret surface, except that a recess is made in the spinneret surface around the capillaries. It is preferred that the outlet opening of the capillaries should form part of the upper side of a truncated cone. Thus, the spinning composition issuing from the capillaries is prevented from coming into contact with the spinneret surface.

According to the present invention, use may be made of various, preferably organic, solvents for polyvinyl alcohol. Favorable results are obtained when the organic solvent employed is a polyvalent alcohol. Examples of suitable polyvalent alcohols are ethylene glycol, glycerol, and 1,3-propanediol.

Favorable results are also achieved when the organic solvent used is dimethyl sulphoxide (DMSO). This solvent, however, is toxic and will decompose when subjected to temperatures above 140° C.

It has been found that when N-methyl pyrrolidone (NMP) is used as solvent, optimum results may be obtained. Not only is this solvent far less toxic than DMSO, it also leads to better yarn properties.

The temperature at which the solution of polyvinyl alcohol (PVA) may be spun is generally in the range of 20° to 250° C. and is dependent in part on the nature of the solvent or mixture of solvents used. When the solvent used is a polyvalent alcohol, the spinning temperature is usually in the range of 175° to 190° C. or higher. When DMSO is employed, the spinning temperature usually is not higher than 80° C., although temperatures in the range of 120° to 150° C. may be used. The coagulation bath is generally kept at ambient temperature or lower.

After leaving the spinneret, the solution of PVA passes through an air gap or inert gas gap prior to coagulation in the coagulation bath. The distance between the spinneret capillaries and the liquid level of the coagulation bath is usually in the range of 2 to 200 mm and preferably in the range of 3 to 20 mm. If the distance is less than 2 mm, the production process becomes extremely complicated, and if it is more than 200 mm, filament breaks may occur.

The coagulation bath usually contains a lower alcohol or an organic solvent such as acetone, benzene, or toluene. Alternatively, mixtures containing a solvent for the PVA may be employed. Another alternative consists in the use of a saturated aqueous solution of an inorganic salt. However, preference is given to an acetone or a lower alcohol such as ethanol, butanol, and especially methanol. Following coagulation, the filaments are wound, extracted with, for example, methanol, and dried.

In order to obtain a yarn of high tenacity, it is preferred that a hot drawing process be applied. The drawing process may be carried out in one or several steps at a temperature in the range of the glass transition temperature to the decomposition temperature and preferably in the range of 190° to 250° C. According to the invention, use may advantageously be made of a process in which the draw ratio is in the range of 10 to 35 and preferably of 15 to 30.

Figure 2:
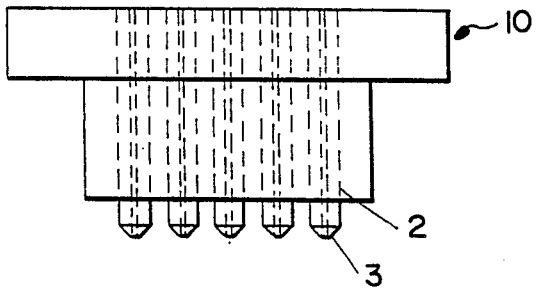
FIG. 2 is an enlarged front view of the spinneret in FIG. 1.
Figure 3:
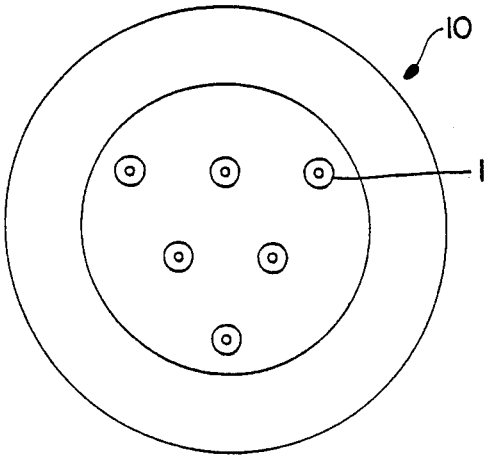
FIG. 3 is an enlarged inverted plan view of the spinneret in FIG. 1.

A spinneret 10 used in the present invention has spinning orifices 1 (FIGS. 1 and 3), and capillaries 2 (indicated with dashed lines in FIG. 2). The spinning orifices have a diameter of about 250 μm. The capillaries are about 9.5 mm long and have truncated cones 3 which are about 0.5 mm high at their free ends. The spinneret illustrated has 6 orifices. However, in the production of a PVA yarn on an industrial scale, the spinneret may have as many as 250, or more, spinning orifices.

The mechanical properties of the yarns prepared in the examples below were determined using an Instron tensile tester at a temperature of 20° C. and a relative humidity of 65%. The gauge length of the filaments was 10 cm and the cross-head speed was 100% per minute. Instron 2712-001 filament clamps fitted with copolyether ester gripping surfaces of $1\times1$ cm$^2$ were used.

The tenacity $\sigma_b$ was determined from the end-point of the stress-strain curve and is given in cN/tex; the maximum modulus $E_{max}$ was determined numerically from the stress-strain curve and is given in N/tex; the elongation at rupture $\epsilon_b$, i.e. increase in length produced by stretching the filament, is expressed as a percentage of the initial gauge length.

To determine the molecular weight, intrinsic viscosity measurements in accordance with standard procedure JIS 6726 (Japanese Industrial Standard: Testing methods for polyvinyl alcohol) were used.

The viscosity average molecular weight $\overline{M}_v$ is then calculated using the Mark-Houwink equation:

$$[\eta]30^\circ\ C.=4.53\times10^{-4}\,\overline{M}_v0.64$$

The invention will be further described in, but is not limited by, the following examples.

EXAMPLE I

PVA (viscosity average molecular weight $\overline{M}_v\approx295{,}000$, degree of saponification 99.9%) was dissolved in dried NMP at 140° C. over a period of 3 hours under a nitrogen atmosphere until a solution containing 20% by weight of PVA was obtained.

The resulting solution was transferred while screened off from air to a cylinder forming part of a miniplunger spinning apparatus. The spinning apparatus contained a spinneret as shown in the FIGS. 1, 2 and 3 (6 orifices having a diameter dp=300 μm) and capillaries of 1 cm in length. The length/diameter ratio of the capillaries was therefore about 33. The filaments were spun at a rate of 2.6 m/min and passed into a methanol coagulation bath through an air gap of about 2 cm. After the coagulation bath, the yarn was wound at a rate of 2.85 m/min. Subsequently, the filaments were subjected to extraction in methanol for 24 hours and then dried in air for 1 hour.

Next, the filaments were hot drawn in two steps. In the first drawing step, the filaments were passed over a hot plate at 205° C. at a feed rate of 14.5 cm/min and wound at a speed of 231 cm/min, which corresponds to a draw ratio of 15.9. In the immediately following second step, the filaments were passed through a hot tube of 235° C., and flushed with nitrogen at a winding speed of 246 cm/min, which corresponds to a total draw ratio of 17.0.

The results of 10 measurements on the resulting filaments were a tenacity of 187 cN/tex, a maximum modulus of 43.5 N/tex and an elongation at rupture of 7.0%.

EXAMPLES II THROUGH VI

In these examples, the effect of a number of solvents at different spinning temperatures was determined. The polyvinyl alcohol used had a viscosity average molecular weight $\overline{M}_v\approx200{,}000$. The testing conditions were identical with those in Example I, except that the spinneret contained only a single capillary with a diameter of 200 μm which, with an identical spinneret length, corresponds to a length/diameter ratio of 25. The spinning temperature, the draw ratio λ, and the properties measured on the resulting filaments are given in Table I below.

TABLE 1

| Example | Solvent | Spinning temp. (°C.) | λ | $\sigma_b$(cN/tex) | (N/tex) | $\epsilon_b$(%) |
|---|---|---|---|---|---|---|
| II | glycol | 175 | 19 | 125 | 44.5 | 3.7 |
| III | glycerol | 190 | 20 | 143 | 44.5 | 4.0 |
| IV | propane-diol-1,3 | 190 | 18 | 113 | 35.0 | 4.1 |
| V | DMSO | 80 | 25 | 162 | 43.0 | 4.8 |
| VI | NMP | 100 | 24 | 144 | 35.0 | 4.9 |

EXAMPLES VII THROUGH X

The test of Example V was repeated, except that the spinning concentration was in the range of 12.5 to 20% by weight of PVA in DMSO. The spinning temperature varied from 25° to 55° C. and the draw ratio from 19 to 29. The spinning temperature, draw ratio, and the properties measured on the resulting filaments are given in Table 2 below.

TABLE 2

| Example | Spin conc. % | $T_{spin}$ (°C.) | λ | $\sigma_b$(cN/tex) | E(N/tex) | $\epsilon_b$(%) |
|---|---|---|---|---|---|---|
| VII | 12.5 | 25 | 21 | 131 | 41.7 | 4.1 |
| VIII | 15.0 | 25 | 22 | 132 | 39.5 | 4.6 |
| IX | 17.5 | 55 | 29 | 130 | 42.2 | 3.7 |
| X | 20 | 55 | 19 | 133 | 39.0 | 4.3 |

EXAMPLES XI THROUGH XV

The test of Example I was repeated making use of a polyvinyl alcohol of $\overline{M}_v\approx200{,}000$, to be dissolved in DMSO solvent, a spinning rate of about 1–2 m/min., and a drawing temperature of about 225° C. The spinning concentration, spinning temperature, draw ratio, and the properties measured on the resulting filaments are given in Table 3.

TABLE 3

| Example | Spin conc. % | $T_{spin}$ (°C.) | λ | $\sigma_b$(cN/tex) | E(N/tex) | $\epsilon_b$(%) |
|---|---|---|---|---|---|---|
| XI | 35 | 140 | 11.8 | 90 | 27.4 | 5.9 |
| XII | 30 | 140 | 16.2 | 142 | 35.7 | 6.3 |
| XIII | 25 | 120 | 17 | 114 | 35.2 | 5.3 |
| XIV | 25 | 90 | 15.6 | 110 | 29.8 | 6.2 |
| XV | 20 | 50 | 15.0 | 105 | 30.7 | 5.9 |

EXAMPLES XVI THROUGH XIX

The test of Example I was repeated making use of a polyvinyl alcohol of a $\overline{M}_v \approx 200{,}000$, a spinning rate of about 1–2 m/min, and a drawing temperature of about 225° C. The spinning temperature was kept at 140° C. and the solvent used was NMP. The spinning concentration, draw ratio, and the properties measured on the filaments are given in Table 4.

TABLE 4

| Example | Spin conc. % | λ | $\sigma_b$(cN/tex) | E(N/tex) | $\epsilon_b$(%) |
|---|---|---|---|---|---|
| XVI | 25 | 15.0 | 130 | 32.2 | 6.5 |
| XVII | 25 | 16.6 | 140 | 30.7 | 7.6 |
| XVIII | 25 | 16.8 | 140 | 31.0 | 7.0 |
| XIX | 25 | 18.2 | 152 | 43.9 | 4.9 |

EXAMPLES XX THROUGH XXV

The test of Example I was repeated using the solvents DMSO and NMP, respectively, PVA of different molecular weights $\overline{M}_v$, and differing spinning concentrations and draw ratios. The molecular weight of the PVA used, the degree of saponification of the PVA, the solvent, the spinning concentration, the draw ratio, and also the properties measured on the filaments are given in Table 5 below.

TABLE 5

| Example | $\overline{M}_v \times 10^{-5}$ | degree of saponification % | solvent | spin. con. wt. % | λ | $\sigma_b$ (cN/tex) | E (N/tex) | $\epsilon_b$ (%) |
|---|---|---|---|---|---|---|---|---|
| XX | 2.0 | 98–99 | DMSO | 25 | 16 | 97 | 28.6 | 5.3 |
| XXI | 1.15 | 99.9 | DMSO | 25 | 17 | 110 | 28.4 | 6.1 |
| XXII | 2.1 | 99.9 | DMSO | 25 | 17 | 107 | 30.0 | 5.5 |
| XXIII | 2.1 | 99.9 | NMP | 25 | 18.5 | 129 | 32.2 | 6.5 |
| XXIV | 2.95 | 99.9 | DMSO | 20 | 19 | 171 | 41.6 | 6.1 |
| XXV | 2.95 | 99.9 | NMP | 20 | 17 | 187 | 43.5 | 7.0 |
| Comparative Example | 0.95 | 99.5 | DMSO | 25 | 17 | 82 | 25.6 | 6.1 |

The results given in the table above clearly show that at a $\overline{M}_v < 10^5$ (Comparative Example), the properties are inferior to those resulting from a PVA having a $\overline{M}_v > 10^5$.

The above table also shows that the most favorable results are obtained with a PVA having the highest possible degree of saponification (Ex. XX vs. Ex. XXII) and when NMP is used as the solvent (Ex. XXII vs. Ex. XXIII; Ex. XXIV vs. Ex. XXV).

EXAMPLE XXVI (Comparative Example)

The test of Example I was repeated making use of a polyvinyl alcohol of a $\overline{M}_v \approx 200{,}000$, to be dissolved in DMSO, spinning concentrations in the range of 15 to 30% and spinning temperatures in the range of 25° to 150° C., except that wet-spinning spinneret was used having 30 capillaries with a length/diameter ratio of 1 for a diameter of 70 μm.

In no case could a stable spinning situation be created. Dripping occurred continuously from one or more spinning capillaries.

EXAMPLE XXVII

A plunger-type spinning machine with a 6-orifice spinneret was used. The die base consisted of polyphenylene sulfide reinforced with 30% by weight of carbon fibers. The 6 outlet openings had a diameter $d_p = 220$ micron and a length of 3.5 mm. For spinning, a solution of 25% by weight of PVA in NMP was used. The PVA had a molecular weight of 210,000.

The solution was pressed by the plunger die through the die base and passed through an air gap (=1 cm) into a coagulation bath of methanol. The filaments were spun at a rate of 3.0 m/min. After the coagulation bath, the yarn was wound at a rate of 3.6 m/min. Thereafter, the bobbin with the yarn was extracted in methanol for 24 hours. After drying in air, the filaments were drawn at a feed rate of 1 mm/sec to a draft ratio of 16 over three hot plates, which respectively had temperatures of 90° C., 230° C. and 245° C. The drawn filaments had the following properties:

Tenacity: 135.3 cN/tex
Elongation at rupture: 6.3%
Modulus: 35.1 N/tex

EXAMPLE XXVIII

A solution of 23% by weight of PVA with a molecular weight of 210,000 in NMP was pressed by an extruder and spinning pump through a die base of polyphenylene sulfide reinforced with 30% by weight of carbon fibers. The 35 outlet openings had a diameter $d_p = 270$ micron and a length of 6.5 mm. The spinning solution passed through an air gap (=1 cm) into a coagulation bath of methanol. The filaments were spun at a rate of 4 m/min and wound at a rate of 8 m/min. Thereupon, the bobbin with the yarn was extracted in methanol for 24 hours. After drying in the air, the filaments were drawn at a feed rate of 32 cm/min over two hot plates, the hot plates having temperatures of 100° C. and 230° C. The draft ratio over the first plate was 7.3, and that over the second plate was 1.8. The total draft ratio was 13.5. The drawn filaments had the following properties:

Tenacity: 127.4 cN/tex
Elongation at rupture: 6.2%
Modulus: 33.1 N/tex

We claim:

1. A process for preparing a yarn having a tenacity of at least 90 cN/tex, comprising:

extruding a solution of a polyvinyl alcohol which has a viscosity average molecular weight $\overline{M}_v$ in the range of $10^5$ to $4 \times 10^5$ in an organic solvent from a spinneret having capillaries into a coagulation bath through an air gap or inert gas gap; and drawing the extruded polyvinyl alcohol solution;

wherein a length of the capillaries of the spinneret in the direction of flow is at least 5 times a diameter of said capillaries, and a concentration of the polyvinyl solution is at least $30-(\overline{M}_v/20{,}000)$ in percent by weight of the polyvinyl alcohol solution.

2. A process according to claim 1, wherein the capillaries of the spinneret have a constant diameter over their entire length.

3. A process according to claim 1, wherein the length/diameter ratio of the capillaries is in the range of 5 to 50.

4. A process according to claim 1, wherein the length/diameter ratio of the capillaries is in the range of 20 to 40.

5. A process according to claim 1, wherein the spinnerets are made from a material selected from the group consisting of carbon-fiber-reinforced polyether ether ketone and polyphenylene sulfide.

6. A process according to claim 1, wherein the polyvinyl solution is extruded from the spinneret through adjacent capillaries at a different level than a level of a top surface of said spinneret.

7. A process according to claim 1, wherein the organic solvent is a polyvalent alcohol.

8. A process according to claim 7, wherein the polyvalent alcohol is selected from the group consisting of ethylene, glycerol, 1,3-propanediol and combinations thereof.

9. A process according to claim 1, wherein the organic solvent is dimethyl sulphoxide.

10. A process according to claim 1, wherein the organic solvent is N-methyl pyrrolidone.

11. A process according to claim 1, wherein said extruded polyvinyl alcohol solution is drawn at a draw ratio in the range of 10 to 35.

12. A process according to claim 11, wherein the draw ratio is in the range of 15 to 30.

13. A process as recited in claim 1, wherein said concentration of the polyvinyl solution is less than or equal to $(40-(\overline{M}_v/20{,}000))$ percent by weight of the polyvinyl alcohol solution.

14. A process for preparing a yarn having a tenacity of at least 90 cN/tex, comprising:

extruding a solution of a polyvinyl alcohol which has a viscosity average molecular weight $\overline{M}_v$ in the range of $10^5$ to $4\times10^5$ in an organic solvent comprising N-methyl pyrrolidone from a spinneret having capillaries into a coagulation bath through an air gap or inert gas gap; and drawing the extruded polyvinyl alcohol solution at a draw ratio in the range of 10 to 35;

wherein a length of the capillaries of the spinneret in the direction of flow is at least 5 times a diameter of said capillaries, and a concentration of the polyvinyl solution is at least $30-(\overline{M}_v/20{,}000)$ in percent by weight of the polyvinyl alcohol solution.

* * * * *